US011592767B2

(12) United States Patent
Taniguchi

(10) Patent No.: US 11,592,767 B2
(45) Date of Patent: Feb. 28, 2023

(54) IMAGE FORMING APPARATUS

(71) Applicant: CANON KABUSHIKI KAISHA, Tokyo (JP)

(72) Inventor: Koichi Taniguchi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/513,219

(22) Filed: Oct. 28, 2021

(65) Prior Publication Data

US 2022/0137536 A1 May 5, 2022

(30) Foreign Application Priority Data

Nov. 5, 2020 (JP) ..... JP2020-185332

(51) Int. Cl.
*G03G 15/16* (2006.01)
*G03G 15/01* (2006.01)

(52) U.S. Cl.
CPC ..... *G03G 15/161* (2013.01); *G03G 15/0131* (2013.01)

(58) Field of Classification Search
CPC ..... G03G 15/161; G03G 15/0131
See application file for complete search history.

(56) References Cited

U.S. PATENT DOCUMENTS

2020/0073291 A1* 3/2020 Takeuchi ..... G03G 15/161

FOREIGN PATENT DOCUMENTS

JP 2012233946 A 11/2012

* cited by examiner

*Primary Examiner* — Clayton E. LaBalle
*Assistant Examiner* — Michael A Harrison
(74) *Attorney, Agent, or Firm* — Canon U.S.A., Inc. IP Division

(57) ABSTRACT

An image forming apparatus includes an image forming unit configured to form a toner image, an intermediate transfer belt configured to transfer the transferred toner image to a recording material at a secondary transfer position, a first cleaning unit arranged downstream of the secondary transfer position and upstream of the primary transfer position in a conveyance direction of the intermediate transfer belt and configured to clean the intermediate transfer belt, a second cleaning unit arranged downstream of the secondary transfer position and upstream of the first cleaning unit in the conveyance direction of the intermediate transfer belt and configured to clean the intermediate transfer belt, a conveyance unit provided opposite to the first and the second cleaning units at a position below the first and the second cleaning units and configured to convey the recording material, and a third space from which the first and the second spaces are accessible.

9 Claims, 4 Drawing Sheets

IMAGE FORMING APPARATUS

BACKGROUND

Field of the Disclosure

The present disclosure relates to an image forming apparatus provided with a belt cleaning device which electrostatically cleans a belt carrying a toner image.

Description of the Related Art

Conventionally, as an electrophotographic image forming apparatus, there is known an image forming apparatus provided with a photosensitive drum corresponding to each color (e.g., yellow, magenta, cyan, and black) and an intermediate transfer belt to which a toner image is transferred from the photosensitive drum.

In the image forming apparatus above, as a cleaning unit of the intermediate transfer belt, there is a method of performing a cleaning by bringing an elastic blade into contact with the intermediate transfer belt. There is a method of electrically collecting a toner, which adheres to the belt, by causing the toner adhere to a collection roller (electrostatic cleaning method). When the belt includes an elastic layer, the latter electrostatic cleaning method is generally used. Electrically collecting toner generally requires an application of a voltage of the order of several kilo volts (KV). In this case, polarity of the toner may be reversed by applying the voltage, and two application rollers are usually used so as to collect the toner having the reversed polarity.

Recently, in order to improve a cleaning property, a configuration in which a third cleaning roller (or brush) is added in addition to the conventional two cleaning rollers has been proposed. (Japanese Patent Application Laid-Open No. 2012-233946)

In the case of the electrostatic cleaning method, other than a fur brush as a cleaning member, a metal roller for applying the voltage to the fur brush and a blade for stripping the toner from the metal roller, or the like, are often provided. For this reason, as the number of cleaning members increases, the number of attached parts also increases, which tends to enlarge the belt cleaning device. In the case of a horizontal conveyance type image forming apparatus that conveys a recording material in a horizontal direction to the secondary transfer section, a sheet conveyance path for conveying a sheet that has passed through the secondary transfer section is usually provided below the cleaning device. Accordingly, as the cleaning device is enlarged, a space above the sheet conveyance path is occupied by the cleaning device, leaving an issue of making it difficult to secure a jam handling space and making it difficult to remove any jam that has occurred below the cleaning device.

In view of the above-described issue, there is a conceivable configuration in which an outer hang roller that stretches the belt from the outside is arranged and the belt arranged above the sheet conveyance path is bent inwardly thereby to reduce the stretched cross-sectional area of the belt and secure the jam handling space, but this leaves an issue of complicating the configuration.

SUMMARY

The present disclosure is directed to providing an image forming apparatus in which a belt is electrostatically cleaned with a fur brush, in which a jam handling space can be secured with a simple configuration even if the number of fur brushes is increased, and in which a decrease in usability during the jam handling can be prevented. The above direction is achieved by the image forming apparatus according to the present disclosure.

According to an aspect of the present disclosure, an image forming apparatus includes an image forming unit configured to form a toner image, an intermediate transfer belt to which the toner image is transferred from the image forming unit at a primary transfer position and configured to transfer the transferred toner image to a recording material at a secondary transfer position, a first cleaning unit arranged downstream of the secondary transfer position and upstream of the primary transfer position in a conveyance direction of the intermediate transfer belt and configured to clean the intermediate transfer belt, wherein the first cleaning unit has a first fur brush and a second fur brush configured to contact the belt and electrostatically collect a toner, and a first container configured to collect the toner collected by the first fur brush and the second fur brush, a second cleaning unit arranged downstream of the secondary transfer position and upstream of the first cleaning unit in the conveyance direction of the intermediate transfer belt and configured to clean the intermediate transfer belt, wherein the second cleaning unit has a third fur brush configured to contact the belt and electrostatically collect the toner, and a second container configured to collect the toner collected by the third fur brush, a conveyance unit provided opposite to the first cleaning unit and the second cleaning unit at a position below the first cleaning unit and the second cleaning unit, and configured to convey the recording material which has passed through the secondary transfer position, wherein the first cleaning unit is arranged above the secondary transfer position, and is arranged in such a way that, in a vertical direction, a first space is formed between the first cleaning unit and the conveyance unit, and wherein the second cleaning unit is arranged at a position where the second cleaning unit does not overlap the first cleaning unit when viewed in the vertical direction, and, in the conveyance direction of the recording material, a second space adjacent to the first space is formed at a position located upstream of the first cleaning unit and downstream of the second cleaning unit, and a third space from which, when a jam occurs to the conveyance unit, the first space and the second space are accessible, with the conveyance unit being attached.

Further features of the present disclosure will become apparent from the following description of exemplary embodiments with reference to the attached drawings.

DESCRIPTION OF THE EMBODIMENTS

An image forming apparatus according to the present exemplary embodiment will be described with reference to drawings. The dimensions, materials of the components of the image forming apparatus and the relative positions, etc., of the components are not intended to limit the scope of the present exemplary embodiment to them alone, unless otherwise specifically stated. Those marked with the same sign in each figure have the same configuration or operation, and any duplicate explanation of these items has been omitted as appropriate.

<Image Forming Apparatus>

Figure 1:
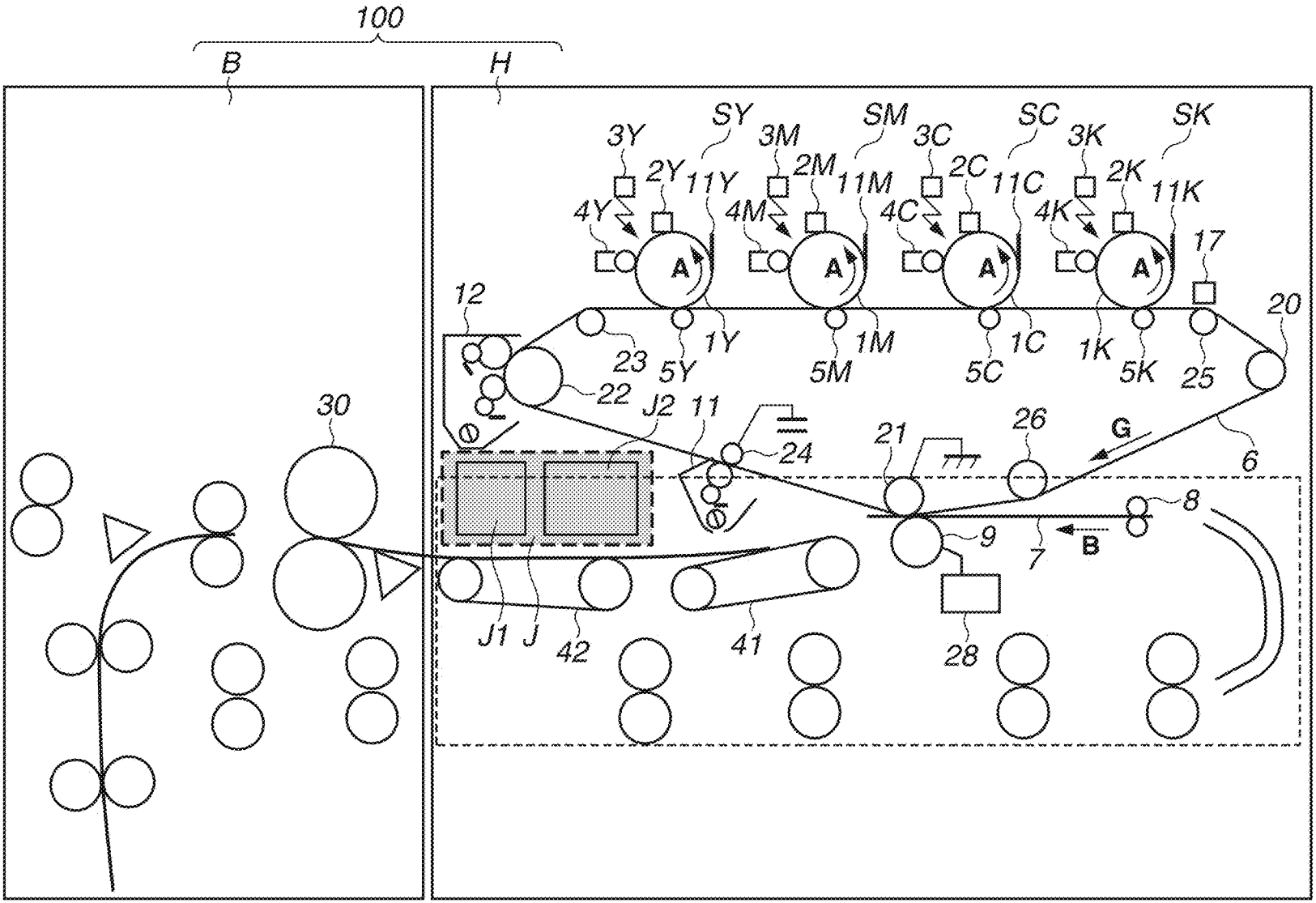
FIG. 1 is a diagram illustrating an entire image forming apparatus.

FIG. 1 illustrates a schematic configuration of an image forming apparatus according to the present exemplary embodiment. The image forming apparatus 100 has first, second, third, and fourth image forming units (stations) SY, SM, SC, and SK that form yellow (Y), magenta (M), cyan (C), and black (K) images, respectively, as a plurality of image forming units. The first, second, third, and fourth image forming units SY, SM, SC, and SK are arranged in this order at equal intervals along a movement direction of an intermediate transfer belt 6 which will be described below. Elements having the same or corresponding functions or configurations in each of the image forming units SY, SM, SC and SK may be described in a comprehensive manner by omitting Y, M, C, and K at the end of the sign indicating that the element is for any of the colors.

As illustrated in FIG. 1, photosensitive drums 1Y, 1M, 1C, and 1K (latent image carriers) rotate in the direction indicated by an arrow line A, and their front sides are uniformly charged by charge devices 2Y, 2M, 2C, and 2K. Exposure devices 3Y, 3M, 3C, and 3K expose the photosensitive drums 1Y, 1M, 1C, and 1K based on image information. Electrostatic latent images corresponding to the image information are formed on the photosensitive drums 1Y, 1M, 1C and 1K by a known electrophotographic process.

Development devices 4Y, 4M, 4C, and 4K contain colored toners, that is, yellow (Y), magenta (M), cyan (C), and black (K) toners, respectively. The aforementioned electrostatic latent images are developed by the development devices 4Y, 4M, 4C, and 4K, and toner images are formed on the surfaces of the respective photosensitive drums 1Y, 1M, 1C, and 1K. A reversible development method is used, by which the toner is caused to adhere to an exposed section of the electrostatic latent image and is developed.

The intermediate transfer belt 6 is arranged to be in contact with the front side of the photoconductor drum 1. The intermediate transfer belt 6 is stretched by a plurality of tension rollers 20, 21, 22, 23, 25, 26 thereby to rotationally move at 150-470 mm/sec in a direction indicated by an arrow G. In the present exemplary embodiment, the tension roller 20 is a tension roller that controls the tension of the intermediate transfer belt 6 to be at a constant level. The tension roller 22 is a drive roller (downstream roller) of the intermediate transfer belt 6. The tension roller 21 is an opposing roller for a secondary transfer. The opposing roller 21 is provided in contact with an inner surface of the intermediate transfer belt 6 at a secondary transfer position, and cooperates with a secondary transfer roller 9 thereby to form a secondary transfer nip.

The secondary transfer roller 9 cooperates with the intermediate transfer belt 6 thereby to form the secondary transfer nip, and holds and conveys a transfer material. At the secondary transfer position (secondary transfer nip), the secondary transfer roller 9 secondarily transfers the toner image from the intermediate transfer belt 6 to the transfer material (recording material).

At a primary transfer position, primary transfer rollers 5Y, 5M, 5C, 5K primarily transfer, onto the intermediate transfer belt 6, the toner image on the respective photosensitive drums 1Y, 1M, 1C, and 1K. The primary transfer rollers 5Y, 5M, 5C, 5K are so arranged to oppose the respective photosensitive drums 1Y, 1M, 1C, and 1K via the intermediate transfer belt 6. A transfer bias having a polarity opposite to that of the toner image and a voltage controlled to be constant is applied to the primary transfer rollers 5Y, 5M, 5C, 5K.

A transfer roller, which includes an elastic layer of ion-conductive foam rubber and a core metal, has an outer diameter of 15 to 20 mm, and has a resistance value of 1E+5 to 1E+8Ω at 23° C., by 50% relative humidity (RH) environmental measurement, and with 2 KV application, is used as each of the primary transfer rollers 5Y, 5M, 5C, 5K.

A transfer roller, which includes an elastic layer of ion-conductive foam rubber and a core metal, has an outer diameter of 20 to 25 mm, and has a resistance value of 1E+5 to 1E+8Ω at 23° C., by 50% RH environmental measurement, and with 2 KV application, is used as the secondary transfer roller 9.

A transfer roller, which includes an electronically conductive rubber elastic layer and a core metal, has an outer diameter of 20 to 22 mm, and has a resistance value of 1E+5 to 1E+8Ω at 23° C., by 50% RH environmental measurement, and with 50 V application, is used as the tension roller 21.

A resist roller 8 supplies a transfer material 7 to the secondary transfer section in synchronization with the toner image on the intermediate transfer belt 6 being conveyed to the secondary transfer nip.

At this time, the transfer bias having the polarity opposite to that of the toner image and the voltage controlled to be constant is applied to the secondary transfer roller 9. For example, a transfer voltage of +1 to +7 KV and a current of +40 to +120 μA are applied to the secondary transfer roller 9, thereby to transfer, to the transfer material 7, the toner image on the intermediate transfer belt 6.

The transfer material 7 is conveyed and introduced to a fixing device 30 by a pre-fixing conveyance device 41 and a pre-fixing conveyance device 42 which form a conveyance path for conveying a sheet which has passed through the secondary transfer position, and the transfer material 7 undergoes a heat and pressure fixing process of the toner image. The pre-fixing conveyance devices 41 and 42 each have a belt body rotationally moving in the center section in the width direction, and the transfer material 7 is placed on the belt body and is conveyed. The belt body is made of a rubber material such as ethylene propylene diene methylene (EPDM) with a width of 100 to 110 mm and a thickness of 1 to 3 mm, and has holes with a diameter of 3 to 7 mm, and the belt body is sucked from the inside thereby to increase a force for carrying the transfer material 7 and stabilize conveyability. The pre-fixing conveyance devices 41 and 42 form a conveyance unit and are so configured as to be pulled out to the front side of a main body of the apparatus.

The pre-fixing conveyance device 41 is arranged below an electrostatic cleaning device 11. The upstream side of the pre-fixing conveyance device 41 in the recording material conveyance direction is arranged above the electrostatic cleaning device 11 and below the secondary transfer position. In this way, the transfer material 7 can be smoothly passed from the secondary transfer position to the pre-fixing conveyance device 41 while securing a space in which the electrostatic cleaning device 11 is arranged.

The electrostatic cleaning device 11 and an electrostatic cleaning device 12 electrostatically collect and clean a secondary transfer residual toner on the intermediate transfer belt 6. The cleaned intermediate transfer belt 6 is repeatedly used in the image forming and image making processes.

The configuration of the apparatus according to the present exemplary embodiment is divided into a first housing H and a second housing B which is provided with a waste sheet process unit including the fixing device 30, as illustrated in FIG. 1. With this configuration, changing the fixing device 30 and the waste sheet process unit can vary productivity and output.

<Electrostatic Cleaning Device>

Figure 2:
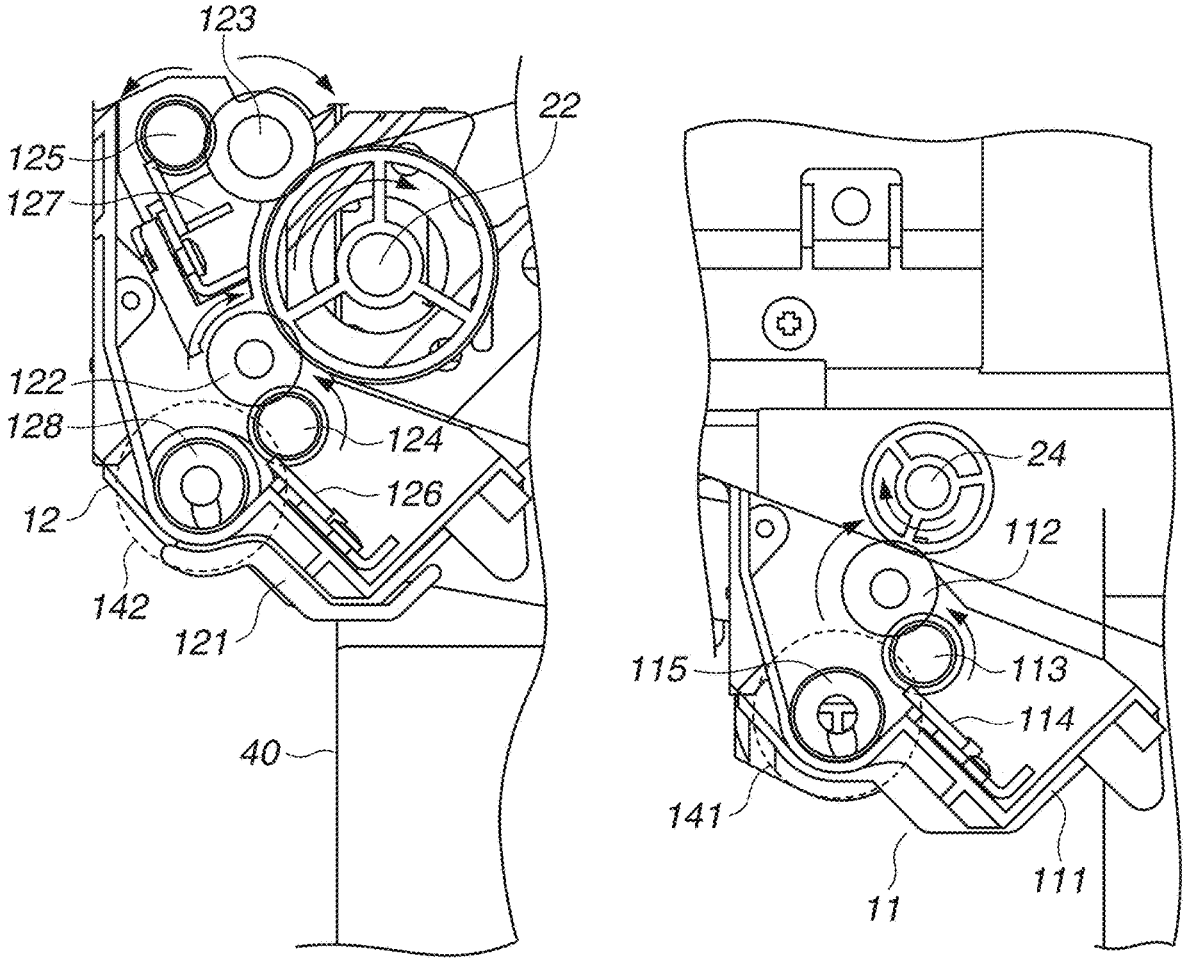
FIG. 2 is a diagram illustrating a cleaning device.

As illustrated in FIG. 2, the electrostatic cleaning device 12 (first cleaning unit), which is a belt cleaning device, has an device housing 121 as a cleaning container arranged near the intermediate transfer belt 6. Electrostatic fur brushes 122 and 123 are rotatably supported by the device housing 121. Other than the electrostatic fur brushes 122 and 123, aluminum metal rollers 124 and 125, and cleaning blades 126 and 127 are provided inside the device housing 121. The electrostatic cleaning device 12 is unitized, and is so configured as to be detachable from the intermediate transfer belt 6 when an intermediate transfer unit as a transfer unit provided with the intermediate transfer belt 6 is detached from the main body of the apparatus.

As illustrated in FIG. 2, the electrostatic cleaning device 11 (second cleaning unit), which is a belt cleaning device, has a device housing 111 as a cleaning container arranged near the intermediate transfer belt 6. An electrostatic fur brush 112 is rotatably supported by the device housing 111. Other than the electrostatic fur brush 112, an aluminum metal roller 113 and a cleaning blade 114 are provided inside the device housing 111. The electrostatic cleaning device 11 is unitized separate from the electrostatic cleaning device 12, and is so configured as to be detachable from the intermediate transfer belt 6 when the intermediate transfer unit provided with the intermediate transfer belt 6 is detached from the main body of the apparatus.

The fur brush includes carbon-dispersed nylon fibers, acrylic fibers, or polyester fibers having a thread resistance value of 3E+5 to 1E+13 (Ω/cm) and a fiber thickness of 2 to 15 denier, planted on a metal roller at a planting density thereof of 50,000 to 500,000 fibers/inch$^2$.

The above electrostatic fur brushes 112, 122, and 123 are slidably arranged while maintaining an intrusion amount of about 1.0 to 2.0 mm to the intermediate transfer belt 6, and are so formed as to rotationally move, by a drive motor not illustrated, in an arrow direction at a speed of 20 to 80% of a conveyance speed of the intermediate transfer belt 6. The metal rollers 113, 124, 125 are so arranged as to maintain an intrusion amount of 1.5 to 2.5 mm to the electrostatic fur brushes 112, 122, 123 and are so arranged as to rotate in an arrow direction at the same speed as the speed of the electrostatic fur brushes 112, 122, 123. The cleaning blades 114, 126, and 127 which come into contact with the metal rollers 113, 124, and 125 are plate-shaped rubber such as urethane. The cleaning blades 114, 126 and 127 each have a thickness of 1.6 to 2.2 mm and an international rubber hardness degrees (IRHD) hardness of 70 to 780 (23° C., 50% RH), and are arranged on the metal roller while maintaining an intrusion amount of 0.5 to 2.0 mm.

Toner conveyance members 115 and 128 have screw shapes, are rotatably provided inside toner conveyance paths 141 and 142, respectively, and convey the toner along with the rotation.

In the electrostatic cleaning device 11, an opposing cleaning roller 24 is so provided as to oppose the electrostatic fur brush 112 in such a way that the intermediate transfer belt 6 is arranged between the opposing cleaning roller 24 and the electrostatic fur brush 112. A constant-current-controlled DC voltage of −20 μA in negative polarity is applied to the opposing cleaning roller 24 by a DC power supply (−20 μA in the present exemplary embodiment, but not limited thereto). With the voltage applied to the opposing cleaning roller 24, the electrostatic fur brush 112 arranged at the most upstream with respect to the rotational direction of the intermediate transfer belt 6 electrostatically cleans the toner remaining on the intermediate transfer belt 6.

The electrostatic fur brushes 122 and 123 provided in the electrostatic cleaning device 12 are arranged opposite the tension roller 22 in such a way that the intermediate transfer belt 6 is arranged between the electrostatic fur brushes 122 and 123 and the tension roller 22.

The electrostatic fur brush 122 is arranged next to the electrostatic fur brush 112 with respect to the rotational direction of the intermediate transfer belt 6. The electrostatic fur brush 122 is so configured as to be supplied with an electric current from the metal roller 124. The metal roller 124 is subjected to an application, by the DC power supply, of the constant-current-controlled DC voltage of −40 μA in negative polarity (−40 μA in the present exemplary embodiment, but not limited thereto). The electrostatic fur brush 123 is located at the most downstream with respect to the rotational direction of the intermediate transfer belt 6. A constant-current-controlled DC voltage of +20 μA in positive polarity is applied to the metal roller 125 by the DC power supply thereby to supply current to the electrostatic fur brush 123 (+20 μA in the present exemplary embodiment, but not limited thereto). A cleaning electric field suitable for cleaning is formed between the fur brushes 112, 122, and 123 and the intermediate transfer belt 6, and the transfer residual toner on the intermediate transfer belt 6 adheres to and collected by the fur brushes 112, 122, and 123. The adhering and collected toner is further transferred from the fur brushes 112, 122, 123 to the metal rollers 113, 124, 125 by an electric field, and scraped off by the cleaning blades 114, 126, 127. The scraped-off toner is conveyed to a collection container by the toner conveyance member.

<Layout Configuration of Electrostatic Cleaning Device>

The arrangement of the electrostatic cleaning device according to the present exemplary embodiment will be described.

As described above, the cleaning device illustrated in FIG. 2 is divided into a first cleaning unit (first electrostatic cleaning device 12) and a second cleaning unit (second electrostatic cleaning device 11). The electrostatic cleaning device 12 as the first cleaning unit is provided with the first electrostatic fur brush 122 and the second electrostatic fur brush 123 described above. The electrostatic cleaning device 11 as the second cleaning unit is provided with the third electrostatic fur brush 112.

The electrostatic cleaning device 11 is arranged upstream of the electrostatic cleaning device 12 in the conveyance direction of the intermediate transfer belt 6. Further, the electrostatic cleaning device 11 is located vertically below the lower surface of the electrostatic cleaning device 12.

In the present exemplary embodiment, the electrostatic cleaning device 11 is arranged upstream (on the right side of the sheet plane in FIG. 3) of the upstream end of the electrostatic cleaning device 12 in the conveyance direction of the transfer material 7. The electrostatic cleaning device 11 is provided at a position that does not overlap the electrostatic cleaning device 12, when viewed in the vertical direction. In this way, a jam handling space J can be secured. In other words, a space that can be accessed during a jam handling can be secured below the electrostatic cleaning device 12. By moving the position of the electrostatic cleaning device 11 away to the secondary transfer position side until the position reaches a position that is below the lower plane of the electrostatic cleaning device 12, the space created on the left side of the electrostatic cleaning device 11 can be used as the jam handling space.

Figure 3:
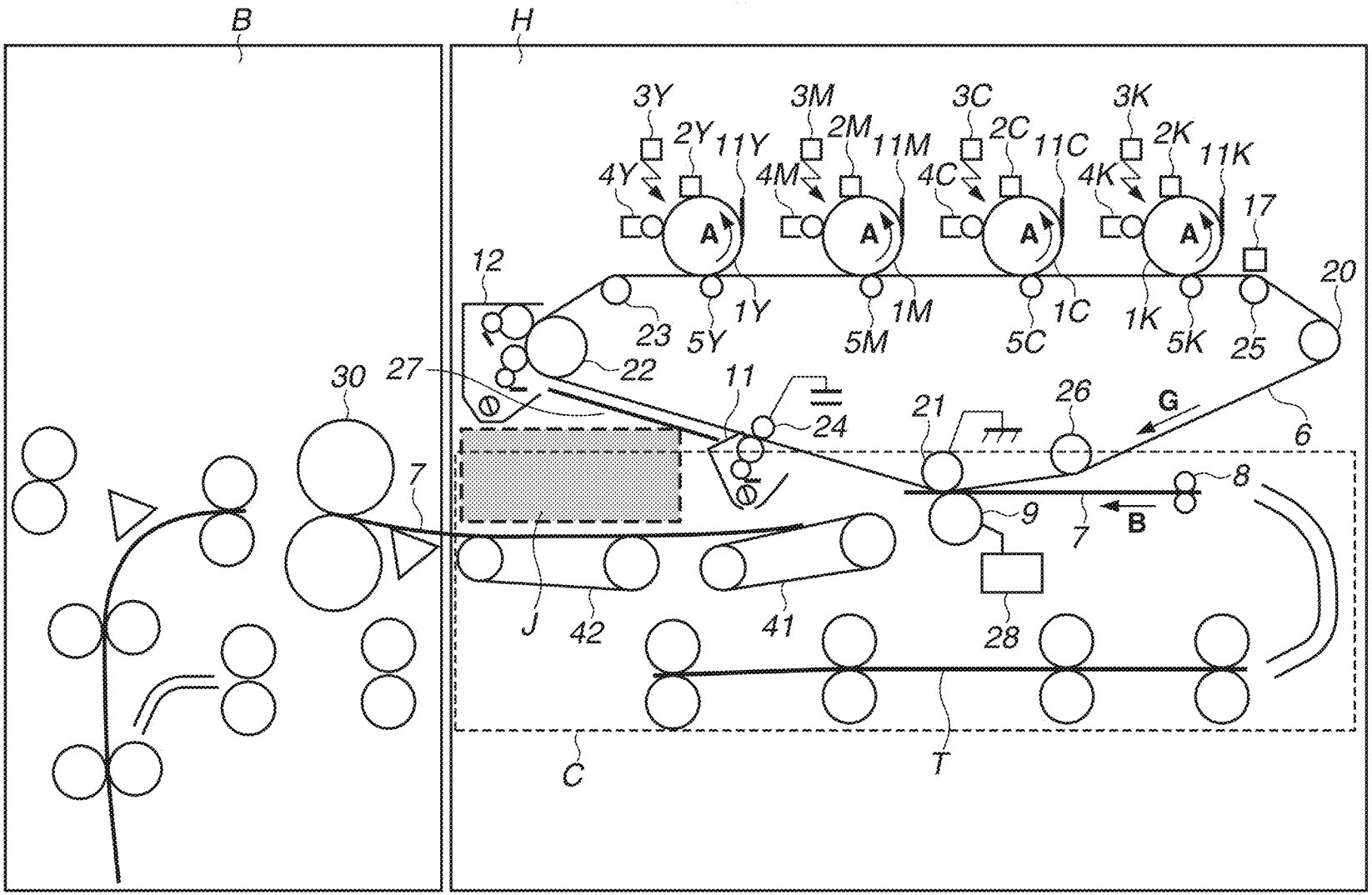
FIG. 3 is a diagram illustrating an arrangement of the cleaning device.

As illustrated in FIG. 3, the jam handling space J includes a first jam handling space J1 as a first space and a second jam handling space J2 as a second space. The first jam handling space J1 is a space provided between the electrostatic cleaning device 12 and the pre-fixing conveyance device 42. In other words, the first jam handling space J1 refers to a space that, when viewed in the vertical direction, overlaps the electrostatic cleaning device 12. The second jam handling space J2 is, in the conveyance direction of the recording material, arranged downstream of the electrostatic cleaning device 11 and upstream of the electrostatic cleaning device 12, is provided between the intermediate transfer belt 6 and the conveyance paths, and is adjacent to the first space. In the present exemplary embodiment, a gap is provided between the electrostatic cleaning device 11 and the electrostatic cleaning device 12 so that, in the conveyance direction of the recording material, the width of the second jam handling space J2 is longer than the width of the first jam handling space J1. In this way, arranging the electrostatic cleaning device 12 above the secondary transfer position forms the first jam handling space J1 between the electrostatic cleaning device 12 and the pre-fixing conveyance device 42. The electrostatic cleaning device 11 is arranged at a position opposite the tensioned section of the intermediate transfer belt 6, which is diagonally tensioned between the electrostatic cleaning device 12 and the secondary transfer position. In addition, the electrostatic cleaning device 11 is, in the conveyance direction of the recording material, arranged in a position away from the electrostatic cleaning device 12. In this way, the second jam handling space J2 can be formed. The width of the second jam handling space J2 in the height direction is equal to or larger than the width of the first jam handling space J1 in the height direction (an interval between the pre-fixing conveyance device 42 and the lowermost plane of the electrostatic cleaning device 12).

In the present exemplary embodiment, an interval of the second jam handling space J2 (width in the left-right direction in FIG. 3) is set to be larger than the width of the electrostatic cleaning device 11 (width in the left-right direction in FIG. 3). When viewed in the width direction of the main body of the apparatus (horizontal direction orthogonal to the width direction of the intermediate transfer belt 6), the electrostatic cleaning device 11 is provided at a position that does not overlap the electrostatic cleaning device 12. That is, the upper plane of the electrostatic cleaning device 11 is arranged below the lower plane of the electrostatic cleaning device 12.

This is because, as illustrated in FIG. 3, the drive roller 22 is arranged above the secondary transfer roller 21, and the intermediate transfer belt 6 is diagonally stretched between the drive roller 22 and the secondary transfer roller 21. The above arrangement makes it possible to provide the space on the left side of the electrostatic cleaning device 11 and in the part J, in FIG. 3, which is directly below the electrostatic cleaning device 12.

To handle the jam, a jammed sheet needs to be pulled out to the right side of FIG. 3. For this reason, it is desirable to secure a large width of the jam handling space J in the left-right direction of FIG. 3. Then, in the present exemplary embodiment, for dividing the image forming apparatus into the electrostatic cleaning device 11 and the electrostatic cleaning device 12, two fur brushes 122 and 123 are arranged on the electrostatic cleaning device 12 side and one fur brush 112 is arranged on the electrostatic cleaning device 11 side. For this reason, the size in the left-right direction can be decreased compared with a case where two fur brushes are provided in the electrostatic cleaning device 11. For this reason, the second jam handling space J2 can be widely secured. The two fur brushes 122, 123 of the electrostatic cleaning device 12 are arranged at a position where the two fur brushes 122, 123 overlap each other when viewed in the vertical direction. For this reason, the size of the electrostatic cleaning device 12 in the left-right direction can be made compact, the interval between the electrostatic cleaning device 11 and the electrostatic cleaning device 12 in the left-right direction can be increased, and the width of the jam handling space J2 can be increased.

<Jam Handling Space>

The jam handling space J according to the present exemplary embodiment will be described. When the main body is in operation, the jam handling space J is blocked by a front cover (not illustrated) of the first housing H. In a case where the front cover is opened when a jam occurs, it can be observed that an opening section (third space) that is substantially identical with the jam handling space J is provided in an inner cover of the first housing H. For this reason, with the transfer unit and the conveyance units being mounted, the user can access the jam handling space J from the opening section.

In other words, when viewed in the width direction of the intermediate transfer belt 6, the opening section for the jam handling is formed at a position including an area where a first area defined by projecting the electrostatic cleaning device 12 in the vertical direction and a second area defined by projecting the electrostatic cleaning device 11 in the left-right direction overlap each other. The opening section for the jam handling is arranged below the electrostatic cleaning device 12, and is provided at a position that is downstream of the electrostatic cleaning device 11 and upstream of the downstream end of the electrostatic cleaning device 12, in the conveyance direction of the transfer material 7. The opening section for the jam handling is, in the horizontal direction orthogonal to the width direction of the intermediate transfer belt 6, provided in such a manner as to extend to an area between the electrostatic cleaning device 11 and the electrostatic cleaning device 12.

The need for the jam handling space J will be explained. As mentioned above, the apparatus according to the present exemplary embodiment includes the first housing H and the second housing B. If the transfer material 7 stops across the first housing H and the second housing B, it is necessary to pull out the transfer material 7 to the first housing H side. Concerning the pull-out direction, in the present exemplary embodiment, the transfer material 7 is pulled out to the right side. The reason for pulling out the transfer material 7 to the first housing H is that a section C (conveyance unit) in FIG. 3 has a configuration (hereinafter referred to as conveyance rail) of being pulled out in front by the user, for the purpose of taking out a transfer material T that has stopped in the double-sided conveyance path.

If the conveyance rail is pulled out without removing the transfer material 7, the transfer material 7 may be jammed between the first housing H and the second housing B, e.g., the transfer material 7 may be damaged and part thereof may remain in the housing (B, H). For this reason, it is necessary to remove the transfer material T after removing the transfer material 7. Providing the jam handling space J makes it possible for the user to pull out the transfer material 7 without any problem.

A required size of the jam handling space J varies depending on a size of a hand or posture of the user, but in the present exemplary embodiment, there is provided a space of 15 cm in the vertical direction and 20 cm in the left-right direction. This makes it possible to pull out the transfer material 7 without any stress, regardless of the size of the hand or the posture. If the above space cannot be provided, it is desirable to have a space of at least 50 mm in the vertical direction and 100 mm in the left-right direction. That is, the size of the opening section is preferably 5 cm or more and 15 cm or less in a longitudinal direction and 10 cm or more and 20 cm or less in a lateral direction.

<Intermediate Transfer Belt Protective Material>

Figure 4:
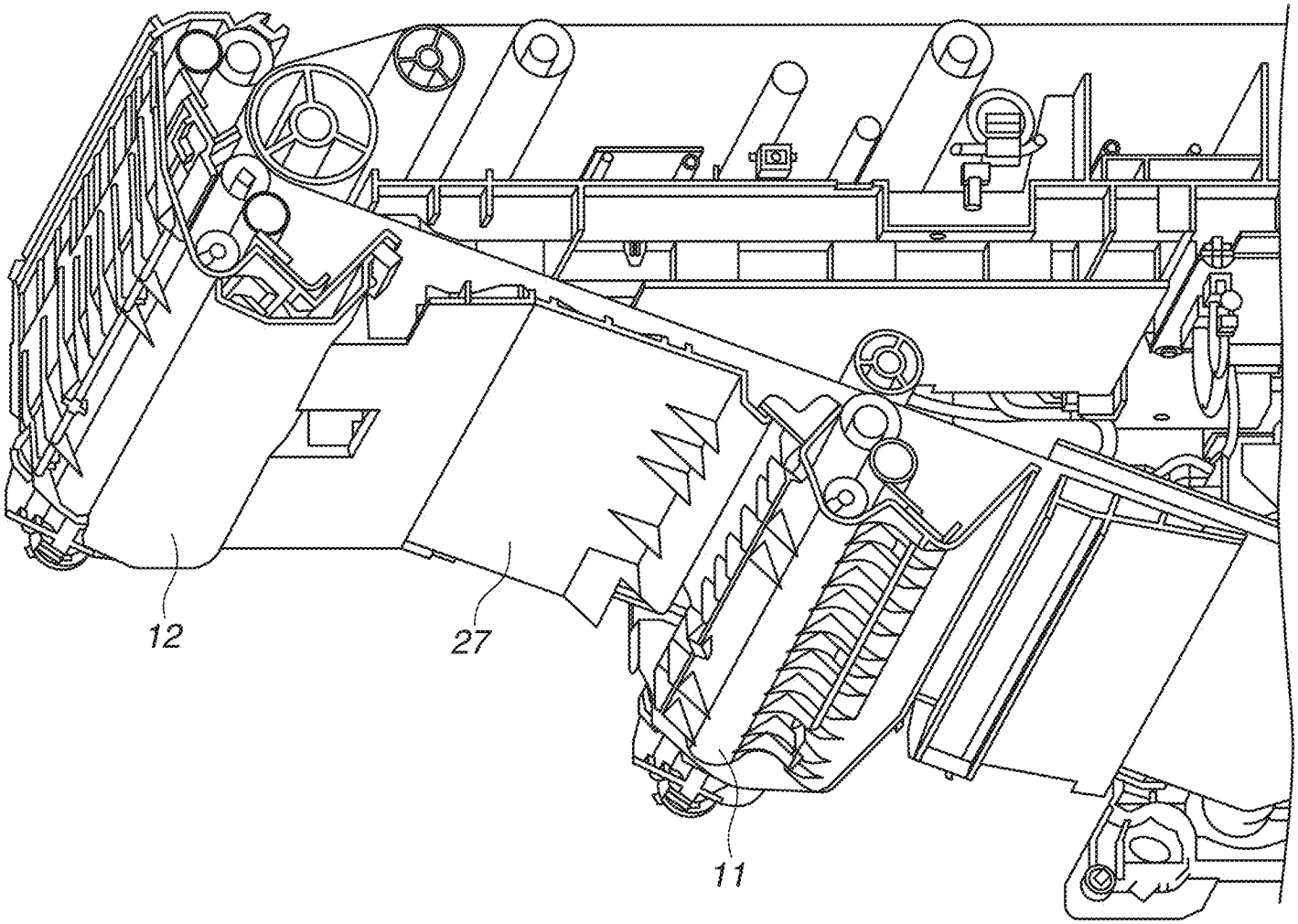
FIG. 4 is a diagram illustrating a protective member.

In the present exemplary embodiment, since the intermediate transfer belt 6 is directly above the jam handling space J, there is a risk of accidentally touching the intermediate transfer belt 6 when the user pulls out the transfer material 7 or grabs the transfer material 7. It is not desirable for the user to touch the intermediate transfer belt 6, because any sebum adhering onto the intermediate transfer belt 6 or scratching the front side would affect the image transferred to the intermediate transfer belt 6. Accordingly, in the present exemplary embodiment, a protective member 27 as a cover member is provided so that the user cannot touch the intermediate transfer belt 6. As illustrated in FIG. 4, the protective member 27 is fixed to the electrostatic cleaning device 12, and is so configured that the protective member 27 is fixed to the electrostatic cleaning device 11 at the same time as the time when the electrostatic cleaning device 11 is mounted. The protective member 27 is larger than a maximum image formation area in the width direction of the intermediate transfer belt 6, and both ends of the protective member 27 are arranged outside both ends of the maximum image formation area.

In the present exemplary embodiment, the example has been illustrated in which, in the rotational direction of the intermediate transfer belt 6, the electrostatic cleaning device 12 is arranged downstream and the electrostatic cleaning device 11 is arranged upstream, but the respective cleaning units may be arranged in reverse. That is, even when the fur brushes 122, 123 are upstream and the fur brush 112 is downstream, the effect can be similarly obtained if the space obtained by dividing the cleaning units can be used as the jam handling space.

In the present exemplary embodiment, the example has been described in which the electrostatic cleaning device 11 is arranged below the lower plane of the electrostatic cleaning device 12, but the electrostatic cleaning device 11 may be below the electrostatic cleaning device 12. A part of the electrostatic cleaning device 11 may be positioned above the lower plane of the electrostatic cleaning device 12.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-185332, filed Nov. 5, 2020, which is hereby incorporated by reference herein in its entirety.

What is claimed is:

1. An image forming apparatus comprising:

an image forming unit configured to form a toner image;

an intermediate transfer belt to which the toner image is transferred from the image forming unit at a primary transfer position, and configured to transfer the transferred toner image to a recording material at a secondary transfer position;

a first cleaning unit arranged downstream of the secondary transfer position and upstream of the primary transfer position in a conveyance direction of the intermediate transfer belt, and configured to clean the intermediate transfer belt, wherein the first cleaning unit has a first fur brush and a second fur brush configured to contact the intermediate transfer belt and electrostatically collect toner, and a first container configured to collect the toner collected by the first fur brush and the second fur brush;

a second cleaning unit arranged downstream of the secondary transfer position and upstream of the first cleaning unit in the conveyance direction of the intermediate transfer belt, and configured to clean the intermediate transfer belt, wherein the second cleaning unit has a third fur brush configured to contact the intermediate transfer belt and electrostatically collect the toner, and a second container configured to collect the toner collected by the third fur brush;

a conveyance unit provided opposite to the first cleaning unit and the second cleaning unit at a position below the first cleaning unit and the second cleaning unit, and configured to convey the recording material which has passed through the secondary transfer position, wherein, when a first space is a space between the first cleaning unit and a conveyance path for the recording material in a projection area in which the first cleaning unit is projected vertically downward, a second space is a space between the intermediate transfer belt and the conveyance path in a projection area in which the intermediate transfer belt disposed upstream of the first cleaning unit and downstream of the second cleaning unit in a conveyance direction of the recording material is projected vertically downward, a first distance is a distance in the conveyance direction of the recording material in the second space, and a second distance is a distance of a space between the second cleaning unit and the conveyance path in a height direction, the first distance is longer than the second distance, and wherein a third space, from which, when a jam occurs unit, the first space and the second space are accessible with the conveyance unit-being attached, is formed to overlap the first space or the second space in a width direction of the intermediate transfer belt orthogonal to a movement direction of the intermediate transfer belt.

2. The image forming apparatus according to claim 1, wherein, when viewed in the width direction of the intermediate transfer belt orthogonal to the conveyance direction of the intermediate transfer belt, the third space is formed at a position including an area where a first area defined by projecting the first cleaning unit in the vertical direction and a second area defined by projecting the second cleaning unit in a horizontal direction orthogonal to the width direction of the intermediate transfer belt overlap.

3. The image forming apparatus according to claim 1, wherein a gap between the first cleaning unit and the second cleaning unit in the conveyance direction of the recording material is longer than a gap between the first cleaning unit and the conveyance path in the vertical direction.

4. The image forming apparatus according to claim 1, further comprising:

a cover member arranged upstream of the first cleaning unit and downstream of the second cleaning unit in the conveyance direction of the intermediate transfer belt, and configured to cover a front surface of the intermediate transfer belt.

5. The image forming apparatus according to claim 1, further comprising:

a first conveyance device arranged below the first cleaning unit and opposite the first cleaning unit and configured to convey the recording material; and a second conveyance device arranged below the second cleaning unit and opposite the second cleaning unit and configured to convey the recording material, wherein the second conveyance device is arranged above the second cleaning unit on an upstream side in the conveyance direction of the recording material.

6. The image forming apparatus according to claim 1, wherein when viewed in a width direction of the intermediate transfer belt, the third space is 5 cm or more and 15 cm or less in a longitudinal direction and 10 cm or more and 20 cm or less in a lateral direction.

7. The image forming apparatus according to claim 1, further comprising:

a first housing configured to house the image forming unit, a transfer unit, and the conveyance unit;

a discharge opening unit provided at the first housing and configured to discharge the recording material from the first housing; and a second housing provided with a reception unit configured to receive the recording material discharged by the discharge opening unit and connected to the first housing, wherein the discharge opening unit is accessible from the third space.

8. The image forming apparatus according to claim 1, wherein the conveyance unit is configured to be pulled out in the width direction of the intermediate transfer belt.

9. The image forming apparatus according to claim 1, wherein a width of the second space in a height direction is equal to or larger than a width between a lowermost plane of the first cleaning unit and the conveyance unit.

* * * * *